US008640614B2

(12) United States Patent
Nishida et al.

(10) Patent No.: US 8,640,614 B2
(45) Date of Patent: Feb. 4, 2014

(54) WORK TRANSFER APPARATUS FOR PRESS MACHINE, AND WORK TRANSFER UNIT

(75) Inventors: Kenji Nishida, Hakusan (JP); Takashi Moriyasu, Komatsu (JP); Hidetoshi Akashi, Kanazawa (JP)

(73) Assignees: Komatsu Ltd., Tokyo (JP); Komatsu Industries Corp., Ishikawa (JP)

( * ) Notice: Subject to any disclaimer, the term of this patent is extended or adjusted under 35 U.S.C. 154(b) by 107 days.

(21) Appl. No.: 13/382,638

(22) PCT Filed: Mar. 29, 2010

(86) PCT No.: PCT/JP2010/055533

§ 371 (c)(1),
(2), (4) Date: Jan. 6, 2012

(87) PCT Pub. No.: WO2011/004644

PCT Pub. Date: Jan. 13, 2011

(65) Prior Publication Data

US 2012/0114451 A1 May 10, 2012

(30) Foreign Application Priority Data

Jul. 6, 2009 (JP) ..... 2009-160142

(51) Int. Cl.
*B30B 15/30* (2006.01)
*B21D 43/05* (2006.01)

(52) U.S. Cl.
USPC ..... 100/207; 72/405.16; 198/621.1

(58) Field of Classification Search
USPC ..... 100/140, 207, 208; 72/405.1, 405.02, 72/405.09, 405.11, 405.12, 405.13, 72/405.16; 483/28, 29; 198/621.1
See application file for complete search history.

(56) References Cited

U.S. PATENT DOCUMENTS

| | | | | |
|---|---|---|---|---|
| 5,452,981 | A * | 9/1995 | Crorey et al. | 198/468.6 |
| 6,073,551 | A | 6/2000 | Dangelmayr et al. | |
| 6,453,718 | B1 * | 9/2002 | Schmeink et al. | 72/405.1 |
| 6,612,229 | B2 * | 9/2003 | Hofele et al. | 100/207 |
| 2007/0289352 | A1 | 12/2007 | Shiroza | |

FOREIGN PATENT DOCUMENTS

| | | | |
|---|---|---|---|
| JP | 2004-243397 | A | 9/2004 |
| JP | 2004-243405 | A | 9/2004 |
| JP | 2006-21235 | A | 1/2006 |

OTHER PUBLICATIONS

International Search Report issued Apr. 10, 2010 in International Application No. PCT/JP2010/055533, 1 page.

* cited by examiner

*Primary Examiner* — Jimmy T Nguyen
(74) *Attorney, Agent, or Firm* — Fish & Richardson P.C.

(57) ABSTRACT

A workpiece transfer apparatus includes: a feed driving mechanism that drives a transfer bar in a workpiece transfer direction; and a lift/clamp driving mechanism that drives the transfer bar in a lift direction and a clamp direction. The lift/clamp driving mechanism includes: a support of the transfer bar; first and second carriers movable in the clamp direction; first and second carrier driving mechanisms that drive the first and second carriers; a parallel link that rotatably connects the first carrier with the support; and a driving link that rotatably connects a first link of the parallel link and the second carrier. A first guide that guides the first carrier and a second guide that guides the second carrier are parallel to each other and are shifted from each other in the workpiece transfer direction.

14 Claims, 12 Drawing Sheets

WORK TRANSFER APPARATUS FOR PRESS MACHINE, AND WORK TRANSFER UNIT

CROSS-REFERENCE TO RELATED APPLICATIONS

This application claims priority to Application No. PCT/JP2010/055533 filed Mar. 29, 2010, which application claims priority to Japanese Application No. 2009-160142, filed on Jul. 6, 2009. The contents of the above applications are incorporated herein by reference in their entireties.

TECHNICAL FIELD

The present invention relates to a workpiece transfer apparatus that transfers a workpiece and a workpiece transfer unit in a press machine.

BACKGROUND ART

A transfer press machines including a plurality of process stations in a press main body is typically provided with a workpiece transfer apparatus that sequentially transfers a workpiece to a subsequent step in process steps.

The workpiece transfer apparatus is provided with a pair of transfer bars that are parallel to a workpiece transfer direction. On each of the transfer bars, a plurality of work holders are detachably provided in a manner to correspond to upper dies and lower dies. The workpiece is sequentially transferred from a position of a die on the upstream side to a position of a die on the downstream side by a three-dimensional movement operation of the transfer bar. The three-dimensional movement operation includes: feed/return directional movement in which the transfer bar is reciprocated in a feed direction, which is the same direction as a workpiece transfer direction; lift/down directional movement (raising/lowering movement) in which the transfer bar is reciprocated in a lift direction (vertical direction); and clamp/unclamp directional movement in which the transfer bar is reciprocated in a clamp direction perpendicular to the feed direction on a horizontal plane.

In such a workpiece transfer apparatus, a workpiece transfer apparatus including the following components has been known as one particularly for moving the transfer bar in the clamp direction and raising/lowering the transfer bar (see, for instance, Patent Literature 1).

Specifically, the workpiece transfer apparatus includes: a first carrier that is movable in the clamp direction; a second carrier that is movable in the clamp direction independent of the first carrier; a first carrier driving mechanism (a ball screw and an electric motor that drives the ball screw) that drives the first carrier in the clamp direction; a second carrier driving mechanism (a ball screw and an electric motor that drives the ball screw) that drives the second carrier in the clamp direction; a parallel link that includes a first link and a second link, connects the first carrier to a support for supporting the transfer bar and are rotatable around a connector between the parallel link and the first carrier and a connector between the parallel link and the support; and a driving link that connects the first link of the parallel link to the second carrier and is rotatable around a connector between the driving link and the first link and a connector between the driving link and the second carrier.

In the workpiece transfer apparatus disclosed in Patent Literature 1, the ball screws of the first and second carrier driving mechanisms are driven by the electric motor, whereby the first and second carriers are reciprocated in the clamp direction, so that the transfer bar provided over the parallel link via the support is also reciprocated in the clamp direction. A clamp-directional movement of the first carrier and that of the second carrier are differentiated in speed, the first carrier having the connectors to the parallel link, the second carrier having the connector to the driving link. With this arrangement, inclination angles of the parallel link and the driving link are changed, so that the transfer bar over the parallel link can be raised/lowered.

As an apparatus that enables the transfer bar to move in three dimensions as described above, an apparatus including a feed driving device that moves the transfer bar in the feed direction, a lift driving device that moves the transfer bar in the lift direction, and a clamp driving device that moves the transfer bar in the clamp direction, has been known (see, for instance, Patent Literature 2).

In the workpiece transfer apparatus disclosed in Patent Literature 2, a lift driving device includes a lift screw (a ball screw) extending in the lift direction. The lift screw is rotated by a lift driving motor, whereby a lift carrier screwed to the lift screw is driven in the lift direction. A clamp driving device includes a lift screw (a ball screw) extending in the clamp direction. The clamp screw is rotated by a clamp driving motor, whereby a clamp carrier screwed to the clamp screw is driven in the clamp direction. A feed driving device includes a linear guide capable of supporting the transfer bar. The transfer bar guided by the linear guide is driven by a linear motor in the linear direction. The clamp driving device is attached to the lift driving device, and the linear driving device is attached to the clamp driving device, which enables three-dimensional movement of the transfer bar.

CITATION LIST

Patent Literatures

| | |
|---|---|
| Patent Literature 1 | Specification of U.S. Pat. No. 6,073,551 |
| Patent Literature 2 | JP-A-2006-21235 |

SUMMARY OF THE INVENTION

Problems to be Solved by the Invention

In the workpiece transfer apparatus disclosed in Patent Literature 1, the transfer bar is moved farthest in the clamp direction by closely providing the first and second carriers. However, since the first and second carriers are only brought close to each other to a limited extent, a total dimension in the clamp direction of the first and second carriers becomes large. Consequently, a moving distance in the clamp direction of the first and second carriers, namely, a large moving range in the clamp direction of the transfer bar cannot be secured.

On the other hand, in the workpiece transfer apparatus disclosed in Patent Literature 2, the clamp driving device is provided on the lift driving device and the feed driving device is provided on the clamp driving device, so that a height dimension of an entirety of these driving devices becomes large. Moreover, since the frame that houses and supports the lift driving device and the clamp driving device needs to be large, a weight of the entire workpiece transfer apparatus is increased. Consequently, it becomes less possible to freely locate the workpiece transfer apparatus in the press main body.

In the workpiece transfer apparatus disclosed in Patent Literature 2, the lift driving device, clamp driving device and the feed driving device are configured to have separate mechanisms. Accordingly, the workpiece transfer apparatus has a large number of kinds of parts and a complicated structure, so that production costs of the workpiece transfer apparatus is increased.

An object of the invention is to provide a workpiece transfer apparatus of a press machine, the workpiece transfer apparatus being capable of enlarging a moving range in the clamp direction of a transfer bar, and a workpiece transfer unit.

Another object of the invention is to provide a workpiece transfer apparatus of a press machine, the workpiece transfer apparatus being capable of being located more freely in a press main body and being produced with reduced costs, and a workpiece transfer unit.

Means for Solving the Problems

According to a first aspect of the invention, a workpiece transfer apparatus for a press machine includes: a pair of transfer bars that are provided parallel to a workpiece transfer direction; a feed driving mechanism that drives the pair of the transfer bars in the workpiece transfer direction; and a lift/clamp driving mechanism that drives the pair of transfer bars in a lift direction to move up and down and drives the pair of transfer bars in a clamp direction perpendicular to the workpiece transfer direction, in which the lift/clamp driving mechanism includes: a support that supports each of the transfer bars; a first carrier that is movable in the clamp direction; a second carrier that is movable in the clamp direction in a manner independent of the first carrier; a first carrier driving mechanism that drives the first carrier in the clamp direction; a second carrier driving mechanism that drives the second carrier in the clamp direction; a parallel link including a first link and a second link that are connected to the first carrier and the support and are rotatable around a connector between the parallel link and the first carrier and a connector between the parallel link and the support; a driving link that is connected to the first link of the parallel link and the second carrier and is rotatable around a connector between the driving link and the first link and a connector between the driving link and the second carrier; a first guide that guides the first carrier to move in the clamp direction; and a second guide that guides the second carrier to move in the clamp direction, the first and second guides being parallel to each other and being shifted therefrom in the workpiece transfer direction.

According to a second aspect of the invention, the connectors between the first and second links of the parallel link and the support are vertically located at different positions and the connectors between the first and second links of the parallel link and the first carrier are vertically located at different positions.

According to a third aspect of the invention, the connector between the first link of the parallel link that is connected to the driving link and the support and the connector between the first link and the first carrier are located at higher positions than positions of the connectors of the second link.

According to a fourth aspect of the invention, the first guide includes a pair of first guides that are parallel to each other, the first carrier is guided by the pair of first guides, the second guide includes a pair of second guides that are parallel to each other, the second carrier is guided by the pair of second guides, and the pair of second guides are located inside the pair of the first guides.

According to a fifth aspect of the invention, the parallel link includes a pair of parallel links, and the pair of parallel links are connected to each other by a connecting bar.

According to a sixth aspect of the invention, the driving link is connected to the parallel link via the connecting bar.

According to a seventh aspect of the invention, the driving link is connected to the connecting bar via a spherical bush.

According to an eighth aspect of the invention, the first carrier driving mechanism comprises a first ball screw that is screwed to the first carrier, the second carrier driving mechanism comprises a second ball screw that is screwed to the second carrier, and the first and second ball screws are vertically located.

According to a ninth aspect of the invention, the feed driving mechanism is interposed between the transfer bar and the support.

According to a tenth aspect of the invention, the workpiece transfer apparatus further includes a balancer cylinder that connects the second carrier to the support.

According to an eleventh aspect of the invention, the workpiece transfer apparatus further includes a frame located on each side of the workpiece transfer direction of a moving bolster, in which the first carrier driving mechanism includes the first ball screw that extends in the clamp direction and a first servo motor that rotates the first ball screw; the second carrier driving mechanism includes the second ball screw that extends in the clamp direction and a second servo motor that rotates the second ball screw; the first and second carriers, the support, the parallel link and the driving link are provided at an upper side of the frame; the first ball screw is screwed to the first carrier and is provided at the upper side of the frame; the second ball screw is screwed to the second carrier and is provided at the upper side of the frame; and the first and second servo motors are provided at a lower side of the frame.

According to a twelfth aspect of the invention, the workpiece transfer apparatus further includes a frame located on each side of the workpiece transfer direction of a moving bolster, in which the first carrier driving mechanism includes the first ball screw that extends in the clamp direction and a first servo motor that rotates the first ball screw; the second carrier driving mechanism includes the second ball screw that extends in the clamp direction and a second servo motor that rotates the second ball screw; the first and second carriers, the support, the parallel link and the driving link are provided at a lower side of the frame; the first ball screw is screwed to the first carrier and is provided at the lower side of the frame; the second ball screw is screwed to the second carrier and is provided at the lower side of the frame; and the first and second servo motors are provided at an upper side of the frame.

According to a thirteenth aspect of the invention, the feed driving mechanism and the lift/clamp driving mechanism are provided between uprights on an upstream side and between uprights on a downstream side of the workpiece transfer direction.

According to a fourteenth aspect of the invention, a workpiece transfer unit provided by arranging at least the lift/clamp driving mechanism into a unit, the lift/clamp driving mechanism being included the workpiece transfer apparatus according to any one of the first to thirteenth aspects of the invention.

Effects of the Invention

The workpiece transfer apparatus according to the first aspect of the invention and the workpiece transfer unit according to the fourteenth aspect of the invention include the lift/clamp driving mechanism that drives the transfer bar in the lift direction and the clamp direction. In the lift/clamp driving mechanism, the support that supports the transfer bar and the first carrier that is movable in the clamp direction are connected to each other by the parallel link. The first link of the parallel link and the second carrier that is movable in the clamp direction are connected to each other by the driving link.

According to the first and fourteenth aspects of the invention, the transfer bar can be moved in the lift direction and the down direction by moving the first carrier toward and away from the second carrier, and can be moved in the clamp direction and the unclamp direction by driving the first and second carriers at the same speed. Since the guide for the first carrier and the guide for the second carrier are separately provided and are shifted from each other in the workpiece transfer direction, the first and second carriers can be brought close to each other to a position where the first and second carriers are lapped (overlapped) in the workpiece transfer direction. Accordingly, the total dimension in the clamp direction of the first and second carriers can be shortened and the moving distance of the first and second carriers can be increased to enlarge the moving range of the transfer bar in the clamp direction.

Since the transfer bar can be moved in the lift direction and the clamp direction only by moving the first and second carriers in the clamp direction, unlike the related arts, it is not necessary to vertically place the lift driving device and the clamp driving device. Accordingly, a height dimension of the workpiece transfer apparatus can be decreased. Consequently, the workpiece transfer apparatus can be located more freely in the press main body.

Although the lift driving device and the clamp driving device are separately provided in the related arts, the lift driving device and the clamp driving device are combined to provide the lift/clamp driving mechanism in the invention. Accordingly, kinds of the parts of the workpiece transfer apparatus can be decreased and a structure thereof can be simplified. Consequently, the production costs thereof can be reduced.

Further, when the workpiece transfer apparatus is provided by units including at least the lift/clamp driving mechanism, in case the lift/clamp driving mechanism has troubles on some parts, the unit having the troubles can be easily replaced, thereby improving maintenance performance.

According to the second aspect of the invention, the connectors between the first and second links of the parallel link and the support are vertically located at different positions and the connectors between the first and second links of the parallel link and the first carrier are vertically located at different positions. Accordingly, as compared with an arrangement in which the connectors are horizontally located at the same height, a dimension in the clamp direction of the first carrier and the support can be shortened, whereby the moving range in the clamp direction of the transfer bar on the support can be enlarged.

According to the third aspect of the invention, the connector between the first link of the parallel link which is connected to the driving link and the support and the connector between the first link which is connected to the driving link and the first carrier are located at higher positions than positions of the connector between the second link of the parallel link and the support and the connector between the second link and the first carrier. Accordingly, when the corresponding connectors of the parallel link are intended to be positioned at the same height, a lap between the first and second carriers in the clamp direction can be increased, whereby the dimension in the clamp direction of the first and second carriers can be more shortened to increase the moving distance.

When the workpiece is transferred by the transfer bar, the transfer bar holding the workpiece is moved at a relatively high position in one cycle. Accordingly, large load is applied by the workpiece and the transfer bar on the first carrier through the parallel link.

For this reason, in the fourth aspect of the invention, the first carrier is arranged across the wider first guide to support load, thereby keeping a stable support.

According to the fifth aspect of the invention, since the parallel link includes a pair of parallel links and the pair of parallel links are connected by the connecting bar, rigidity of the lift/clamp driving mechanism can be enhanced. Accordingly, while the transfer bar is being moved by the feed driving mechanism, shaking and vibration of the lift/clamp driving mechanism are favorably prevented for operation at a higher speed.

According to the sixth aspect of the invention, since the driving link is connected to the parallel link via the connecting bar, the driving link can be connected at any longitudinal position of the connecting bar, whereby the workpiece transfer apparatus is designed more freely.

According to the seventh aspect of the invention, the driving link is connected to the connecting bar via the spherical bush. Accordingly, even when the parallel link and the driving link are temporarily warped during operation, the spherical bush can compensate slippage between the first and second links of the parallel link to continue smooth movement.

According to the aspect of the eighth invention, since the first and second ball screws of the first and second carrier driving mechanisms are vertically shifted, a dimension of the lift/clamp driving mechanism can be shortened.

With this arrangement, the ball screws are screwed to nuts near the first and second carriers. In case the ball screws are coplanarly provided in parallel, in order to bring the first and second carriers close to a position where the first and second carriers are lapped, the ball screws needs to be widely spaced from each other with the need to avoid interference between the nuts. However, according to the eighth aspect of the invention, screwed parts between the ball screws and the first and second carriers are not coplanarly provided. Accordingly, the dimension of the lift/clamp driving mechanism can be reduced in the feed direction.

According to the ninth aspect of the invention, the feed driving mechanism is interposed between the transfer bar and the support and is located close to a to-be-moved transfer bar. Accordingly, transmission loss of driving force for moving the transfer bar in the feed direction is decreased, resulting in efficient movement of the transfer bar in good response to the driving force.

According to the tenth aspect of the invention, since the balancer cylinder is interposed between the second carrier and the support, the balancer cylinder counteracts influence of the weight of the workpiece transfer apparatus given on other components provided between the second carrier and the support. Accordingly, the balancer cylinder only needs to balance the minimum number of the components such as the transfer bar, the support and the feed driving mechanism among operative components, so that the size of the balancer cylinder can be reduced. Consequently, in addition to such size reduction of the workpiece transfer device, a weight of the workpiece transfer device can be reduced. Further, the weight of the components driven by the first and second carrier driving mechanisms can be reduced, thereby reducing drive load applied on the first and second carrier.

According to the eleventh aspect of the invention, since the components of the lift/clamp driving mechanism are provided at the upper side and the lower side of the frame, it is not necessary to house the lift/clamp driving mechanism within the frame. Accordingly, the weight of the frame can be reduced, thereby locating the workpiece transfer apparatus more freely in the press main body.

According to the twelfth aspect of the invention, the components of the lift/clamp driving mechanism are provided at the upper side and the lower side of the frame in the same manner as described above. Accordingly, it is not necessary to house the lift/clamp driving mechanism within the frame and the weight of the frame can be reduced. Moreover, the lift/clamp driving mechanism is located at the upper side of the transfer bar, the view at the lower side of the transfer bar is not obstructed, thereby improving visibility.

According to the thirteenth aspect of the invention, the feed driving mechanism and the lift/clamp driving mechanism are provided on both sides of the workpiece transfer direction. Accordingly, the transfer bar is supported by the feed driving mechanism and the lift/clamp driving mechanism on both the sides of the workpiece transfer direction, whereby separate support mechanisms for the transfer bar in the related arts is combined to provide a common mechanism on both the sides of the workpiece transfer direction. Consequently, the production costs of the workpiece transfer apparatus can be reduced and maintenance check of the workpiece transfer apparatus can be easily performed.

Further, as compared with an arrangement in which the transfer bar is moved by a single lift/clamp driving mechanism, since a single transfer bar is moved by a plurality of lift/clamp driving mechanisms, output driving force required of the first and second carrier driving mechanisms can be reduced and a driving efficiency of the first and second carrier driving mechanisms can be improved. Accordingly, the size and the production costs of the workpiece transfer apparatus can be reduced.

DESCRIPTION OF EXEMPLARY EMBODIMENTS

Figure 1:
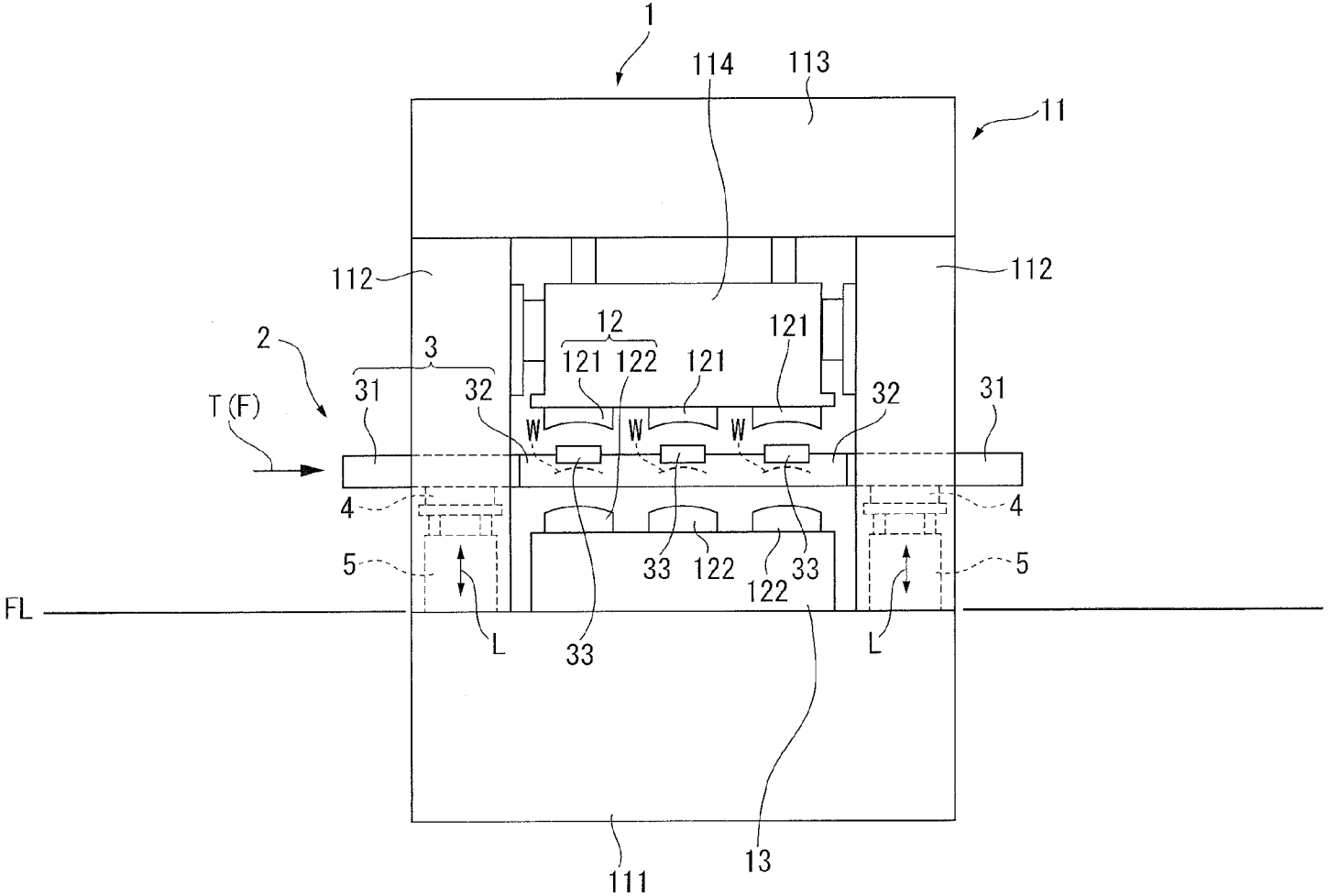
FIG. 1 is a front elevational view showing a press machine according to a first exemplary embodiment of the invention.

Exemplary embodiments of the invention will be described below with reference to the attached drawings. In a second exemplary embodiment and subsequent ones which are later described, the same components as those of a first exemplary embodiment described here will be denoted by the same reference numerals, and the description of the same components will be omitted.

First Exemplary Embodiment

An overall structure of a transfer press (a press machine) 1 according to the first exemplary embodiment of the invention will be described with reference to FIG. 1.

The transfer press 1 includes; a press main body 11 that includes a bed 111, an upright 112, a crown 113 and a slide 114; a die 12 that includes an upper die 121 and a lower die 122; a moving bolster 13; and a transfer feeder (workpiece transfer apparatus) 2.

Figure 6:
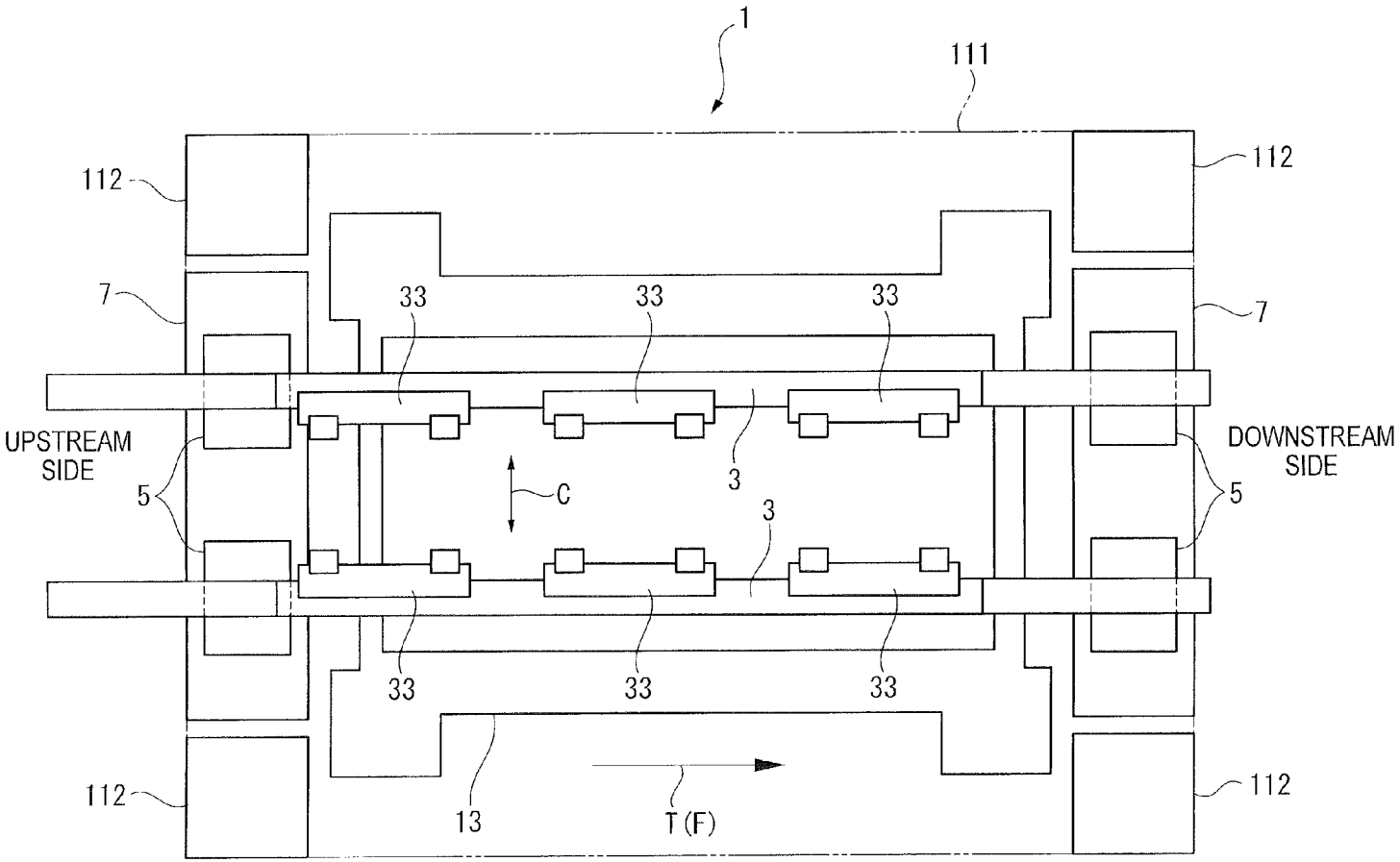
FIG. 6 is a plan view showing the workpiece transfer apparatus according to the first exemplary embodiment.
Figure 7:
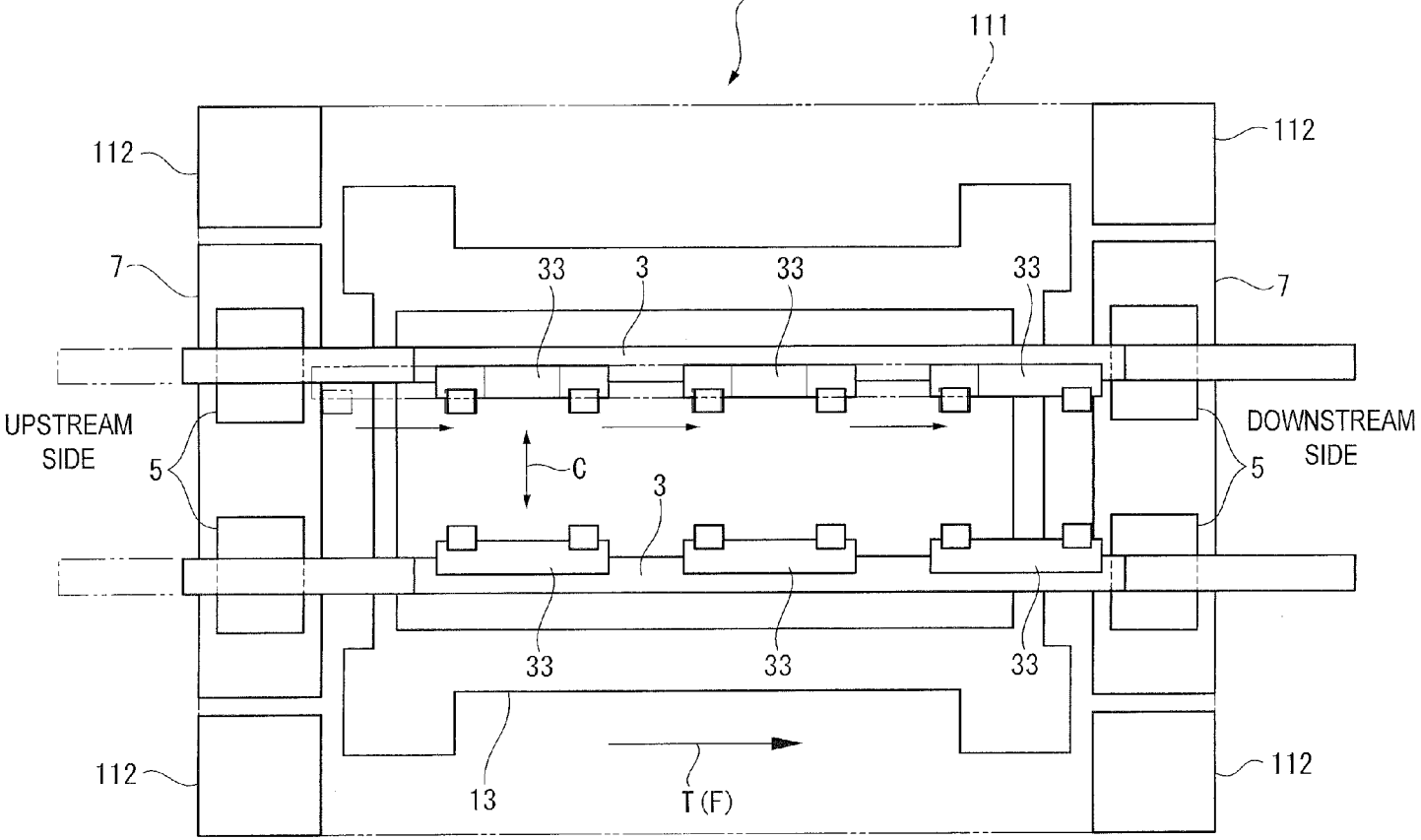
FIG. 7 is a plan view showing the workpiece transfer apparatus according to the first exemplary embodiment.

In the press main body 11, the bed 111 is provided under a floor FL as a base of the transfer press 1 and the upright 112 is vertically provided at each of four corners of the bed 111 that is substantially rectangular in a plan view (see FIGS. 6 and 7). FIG. 1 shows two uprights 112 provided on each of an upstream side and a downstream side of a transfer direction (hereinafter referred to as a workpiece transfer direction) T of a workpiece W.

The crown 113 in which a slide drive device (not shown) is installed are supported on the uprights 112. The slide 114 that is movable up and down by the slide drive device is suspended from the crown 113. A plurality of upper dies 121 corresponding to press-molding steps are detachably provided on a bottom surface of the slide 114 along a feed direction F. The moving bolster 13 is provided on a top surface of the bed 111. A plurality of lower dies 122 (which are respectively paired with the upper dies 121) are detachably provided on a top surface of the moving bolster 30 to face the respective upper dies 121.

The moving bolster 13 is provided in a manner capable of being loaded/unloaded on the top surface of the bed 111 such that a used die 12 is replaced with the next die 12 off-line outside the transfer press 1. A rail (not shown) is laid on the floor FL and the bed 111. The moving bolster 13 includes a drive device by which the moving bolster 13 can be self-propelled on the rail. The moving bolster 13 is self-propelled by the drive device to pass through in clamp direction C (see FIG. 4) between the pair of uprights 112 vertically provided in the feed direction F, so that the moving bolster 13 is unloaded from the inside of the transfer press 1 or loaded from the outside of the transfer press 1.

The moving bolster 13 is typically prepared in a pair of first and second moving bolsters. The first moving bolster 13 carrying the used die 12 is automatically replaced with the second moving bolster 13 on which the next die 12 is mounted in advance off-line outside the transfer press 1, whereby the die 12 can be speedily replaced depending on a type of the workpiece.

Next, the transfer feeder 2 will be described in detail.

In FIG. 1, the transfer feeder 2 includes: a pair of transfer bars (hereinafter referred to as a bar) 3 provided on right and left sides in the workpiece transfer direction T; a feeding linear motor (a feed driving mechanism) 4 that reciprocates the bar 3 in the feed direction F (the same direction as the workpiece transfer direction T); and a lift/clamp driving mechanism 5 that reciprocates the bar 3 in a lift direction L (a vertical direction perpendicular to the feed direction F and the clamp direction C) and in the clamp direction C (see FIGS. 3 and 4).

The pair of bars 3 are provided in parallel along the feed direction F with a predetermined space interposed therebetween and are supported by the lift/clamp driving mechanism 5. The bar 3 includes: a fixed bar 31 supported by the lift/clamp driving mechanism 5; and a movable bar 32 that is detachable from the fixed bar 31 to move with the moving bolster 13 when the die is replaced.

Figure 2:
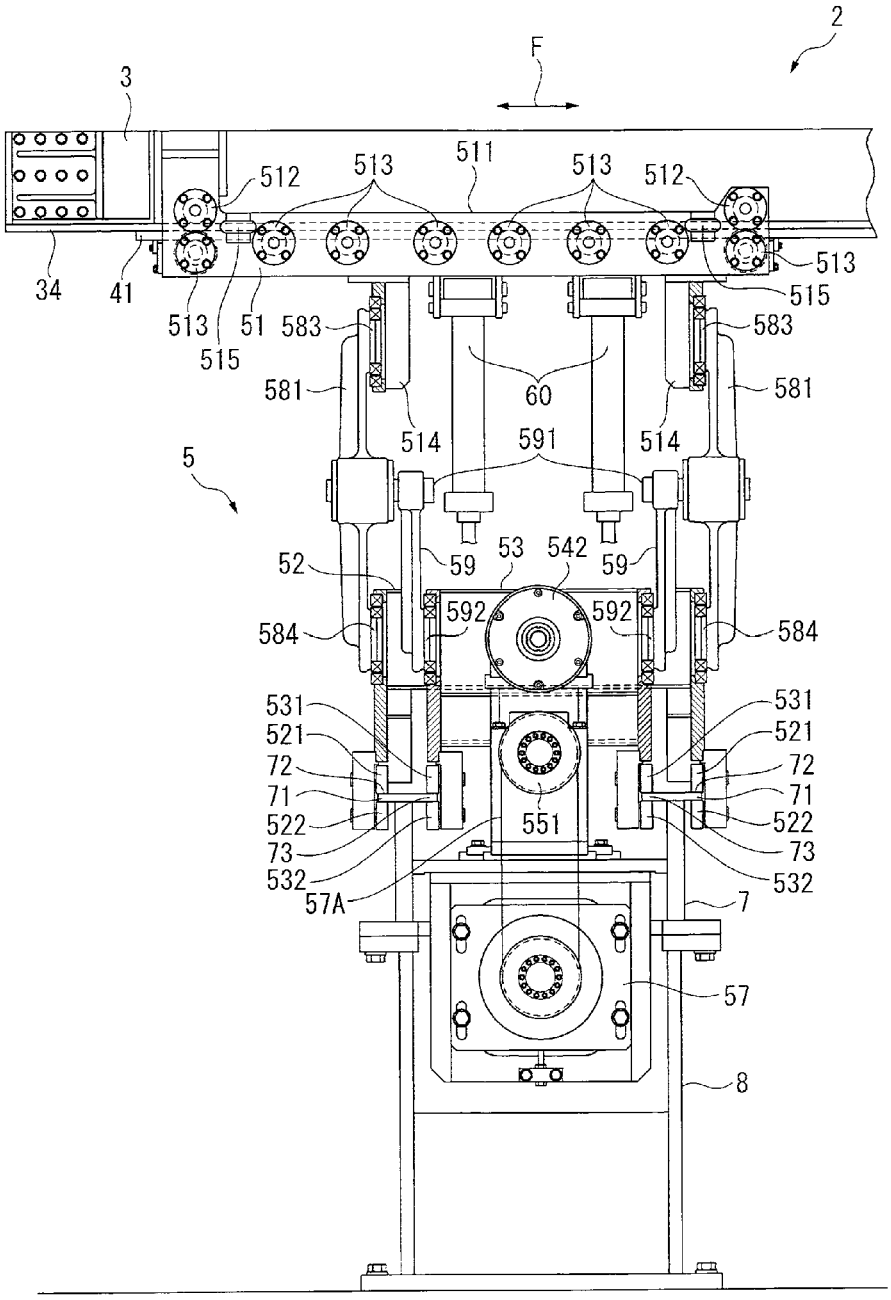
FIG. 2 is a front elevational view showing a partial cross section of a workpiece transfer apparatus according to the first exemplary embodiment.

As shown in FIG. 2, a feeding rail 34 is provided on each of lateral surfaces near both ends of the bar 3. A length of the feeding rail 34 is determined based on a moving distance of the bar 3 in the feed direction F. The feeding rail 34 is guided by a support 51. A workpiece holder 33 that holds the workpiece W is detachably provided to the bar 3. Examples of the workpiece holder 33 are fingers that are provided on the pair of bars 3 to face each other and simultaneously hold the workpiece W, a gripper that grips the workpiece W, and a vacuum cup that holds the workpiece W by vacuum suction.

Figure 3:
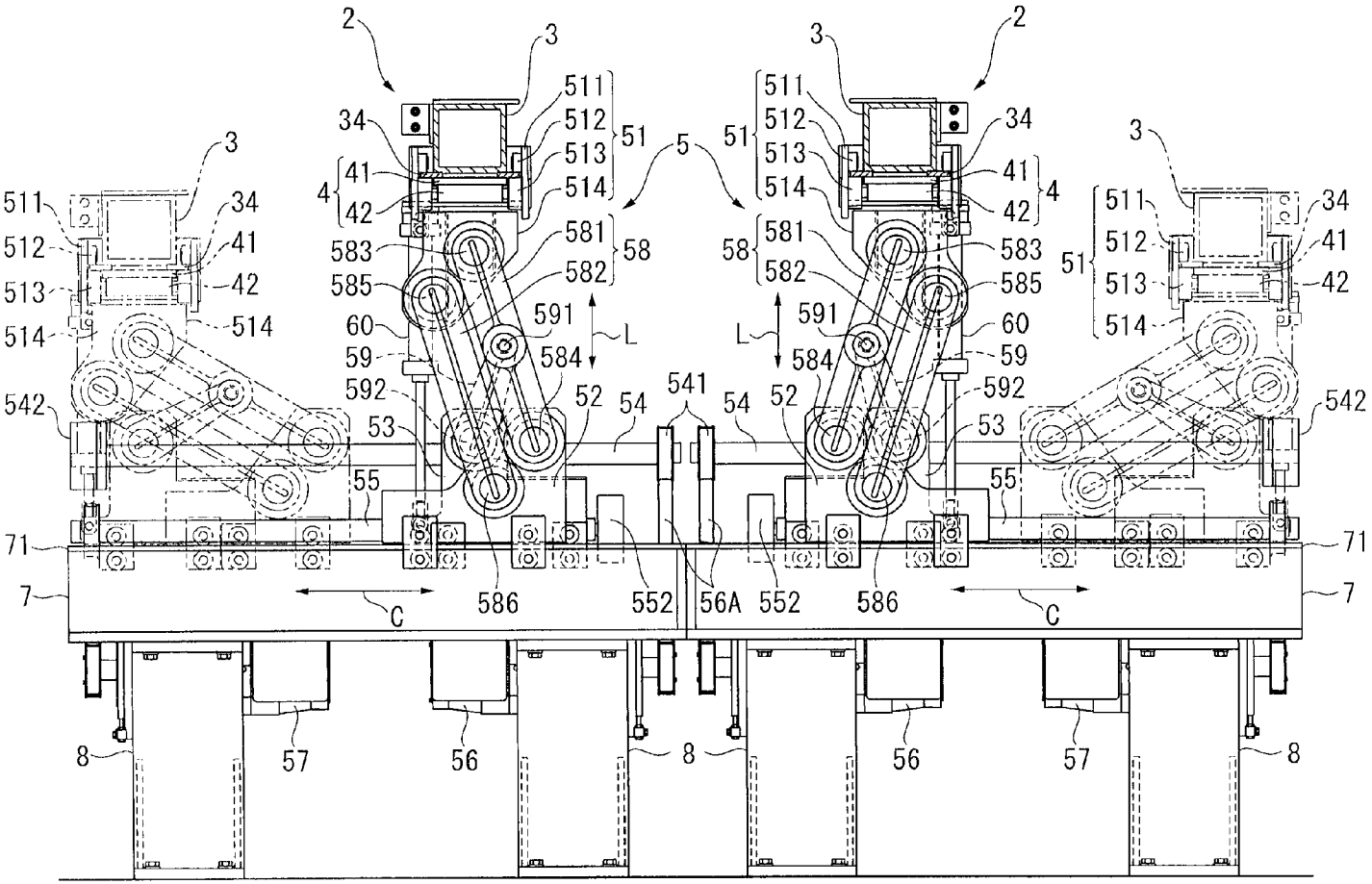
FIG. 3 is a lateral view showing the workpiece transfer apparatus according to the first exemplary embodiment.

As shown in FIG. 3, the feeding linear motor 4 includes: a magnet plate 41 that is laid under a bottom surface of the feeding rail 34 of the bar 3; and a coil plate 42 that faces the magnet plate 41 and is fixed to an inside of the support 51 via a connecting member. When the coil plate 42 is applied with electricity so that a movable magnetic field is produced, the magnet plate 41 is moved due to an attractive force and a repulsive force. Thus, the bar 3 is moved with the magnet plate 41, so that the bar 3 is moved in a feed direction and a return direction.

Herein, description of this exemplary embodiment assumes a case where the magnet plate 41 is provided on the bar 3 and the coil plate 42 is provided on the support 51 in the linear motor. However, the magnet plate 41 may be provided on the support 51 and the coil plate 42 may be provided on the bar 3.

Two uprights 112 are provided on each of the right and left sides in the workpiece transfer direction T. A frame 7 is interposed between the two uprights 112 on each side. A lift/clamp driving mechanism 5 is provided for each of the fixed bars 31 at both ends of each of the bars 3. In total, four lift/clamp driving mechanisms 5 are provided on the frames 7 (see FIGS. 6 and 7).

It is only necessary that the lift/clamp driving mechanisms 5 are placed on both the sides in the workpiece transfer direction T in a manner to sandwich the moving bolster 13. Accordingly, for instance, the respective lift/clamp driving mechanisms 5 may be placed between the moving bolster 13 and the uprights 112 in the workpiece transfer direction T. With this arrangement, a dimension of the transfer feeder 2 in the clamp direction C can be reduced. Accordingly, in comparison with the arrangement in which the lift/clamp driving mechanisms 5 are placed between the uprights 112, restriction on the dimension of the transfer feeder 2 in the clamp direction C can be lessened. On the other hand, a distance between the uprights 112 in the workpiece transfer direction T can be increased, thereby increasing a dimension of the crown 113 and a dimension of the bed 111 in the workpiece transfer direction T. Accordingly, it is required to take a countermeasure to ensure strength of the crown 113 and the bed 11 as needed.

Figure 4:
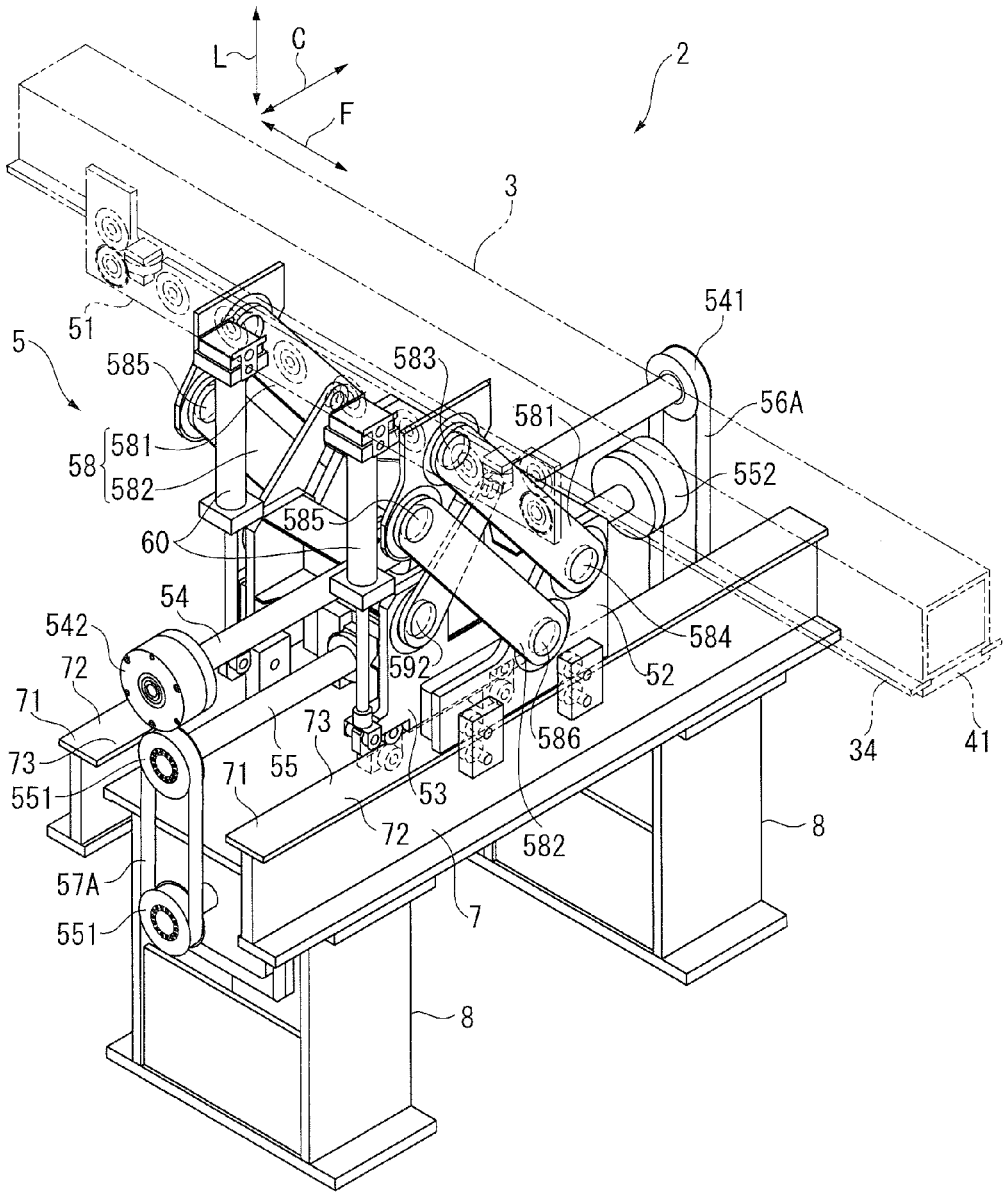
FIG. 4 is a perspective view of a feed driving mechanism and a lift/clamp driving mechanism according to the first exemplary embodiment.

In FIGS. 2 to 4, each of the lift/clamp driving mechanisms 5 includes the support 51, first and second carriers 52 and 53, first and second ball screws 54 and 55, first and second servo motors 56 and 57, a pair of parallel links 58, a pair of driving links 59, and a pair of balancer cylinders 60. The lift/clamp driving mechanism 5 and the frame 7 are provided as a workpiece transfer unit.

The support 51 includes a top-open support body 511 having a concave cross section, an upper guide roller 512, a lower guide roller 513 and a lateral guide roller 514. The upper guide roller 512, the lower guide roller 513 and the lateral guide roller 515 are provided to the support body 511 and guide the feeding rail 34. The aforementioned coil plate 42 is provided on an inner bottom surface of the support body 511. A pair of connectors 514 that each connect the parallel link 58 are provided on an outer bottom surface of the support body 511.

The first and second carriers 52 and 53 are provided at an upper side of the frame 7 supported by frame legs 8 in a manner movable in the clamp direction C. Specifically, the first carrier 52 includes upper guide rollers 521 and lower guide rollers 522 by which a guide rail 71 of the frame 7 is sandwiched. The second carrier 53 includes upper guide rollers 531 and lower guide rollers 532 by which the guide rail 71 of the frame 7 is sandwiched. The first and second carriers 52 and 53 are supported on the frame 7 in a manner to be movable by the guide rollers 521, 522, 531 and 532 in the clamp direction C. The first carrier 52 is screwed with a first ball screw 54. The second carrier 53 is screwed with a second ball screw 55.

A pair of guide rails 71 each have a first edge and a second edge along a width direction. The first edge is defined as an outer guide 72 (a first guide) and the second edge is defined as an inner guide 73 (a second guide). The outer guides 72 of the pair of the guide rails 71 are parallel to each other in a longitudinal direction of the guide rails 71. In other words, the outer edges of the respective guide rails 71 are defined as the outer guide 72 and the inner edges thereof are defined as the inner guide 73. The first carrier 52 bridges the outer guides 72. The upper guide roller 521 and the lower guide roller 522 roll along each of the outer guides 72. On the other hand, the second carrier 53 bridges the inner guides 73. The upper guide roller 531 and the lower guide roller 532 roll along each of the inner guides 73.

Since the first carrier 52 is guided by the outer guides 72 and the second carrier 53 is guided by the inner guides 73, the second carrier 53 is arranged to move to a position where the almost entire second carrier 53 is placed within the first carrier 52. Even when the first and second carriers 52 and 53 are most remote from each other, the first and second carriers 52 and 53 still partially overlap each other. With this arrangement, a total dimension in the clamp direction of the first and second carriers 52 and 53 is reduced, whereby a longer moving distance of the second carrier 53 and, consequently, a moving range larger than typical ones in the clamp direction C of the transfer bar 3 can be secured.

The first and second ball screws 54 and 55, which are provided in the clamp direction C and are vertically shifted from each other (in an offset), are supported by the frame 7. Power transmitters 541 and 551, which respectively receive rotative driving force from the first and second servo motors 56 and 57 fixed under the frame 7, are respectively provided on first ends of the ball screws 54 and 55. Brakes 542 and 552 (e.g., an electromagnetic brake), which respectively stop rotation of the ball screws 54 and 55, are respectively provided on second ends of the ball screws 54 and 55. The power transmitters 541 and 551 are connected to output shafts of the first and second servo motors 56 and 57 via belts 56A and 57A. The first and second carriers 52 and 53 are moved in the clamp direction C along the guide rails 71 of the frame 7 by rotating the ball screws 54 and 55. A first carrier driving mechanism according to this exemplary embodiment includes the first ball screw 54 and the first servo motor 56. A second carrier driving mechanism includes the second ball screw 55 and the second servo motor 57.

The parallel link 58 includes two cast links 581 and 582 placed in parallel. Each of the links 581 and 582 has a longitudinal rib in the middle of a flat plate. First ends of the links 581 and 582 are respectively rotatably connected to the first carrier 52 via connectors 584 and 586. Second ends of the links 581 and 582 are respectively rotatably connected to the support 51 via the connectors 583 and 585. Here, the link 581 is connected to the support 51 and the first carrier 52 at a position higher than a position where the link 582 is connected thereto. Specifically, the connector 583 of the link 581 is connected to the support 51 at a position higher than a position where the connector 585 of the link 582 is connected, and the connector 584 of the link 581 is connected to the first carrier 52 at a position higher than a position where the connector 586 of the link 582 is connected.

Thus, the connector 583 is vertically shifted from (not horizontally parallel to) the connector 585. The connector 584 is vertically shifted from (not horizontally parallel to) the connector 586. Accordingly, a dimension in the clamp direction C of the support body 511 that forms the support 51 and a dimension in the clamp direction C of a lateral side of the first carrier 52 can be reduced. Consequently, when the first and second carriers 52 and 53 are brought close to the uprights 112, a moving range of the transfer bar 3 in the clamp direction C is further enlarged.

The driving link 59 is also a cast plate having a rib. The driving link 59 has connectors 591 and 592 at ends. The driving link 59 is rotatably connected to the first link of the parallel link 58 via the connector 591 and to the second carrier 53 via the connector 592. In this exemplary embodiment, the driving link 59 is connected to the link 581 that is connected to the support 51 and the first carrier 52 at a higher position.

The parallel link 58 and the driving link 59 can move the support 51 in the lift direction in accordance with an inclination angle of the links 581 and 582. In this exemplary embodiment, the driving link 59 is connected to the link 581 placed at a higher position in the parallel link 58. However, the driving link 59 may be connected to the link 582 placed at a lower position.

The second carrier 53 can be moved further inside the first carrier 52 when the driving link 59 is connected to the link 581 placed at a higher position. Accordingly, the total dimension in the clamp direction C of the first and second carriers 52 and 53 can be reduced, thereby further enlarging the moving range.

The balancer cylinder 60 is provided between the second carrier 53 and the support 51 and connects the second carrier 53 and the support 51. The balancer cylinder 60 smoothly lifts up and down the bar 3 supported by the support 51 while balancing weights of the support 51, the feeding linear motor 4, the bar 3 and like which are provided at an upper side of the balancer cylinder 60.

Motion of the transfer feeder 2 with the above arrangement according to this exemplary embodiment will be exemplified by a motion of the transfer feeder when loading the workpiece W into the transfer press 1.

Figure 5:
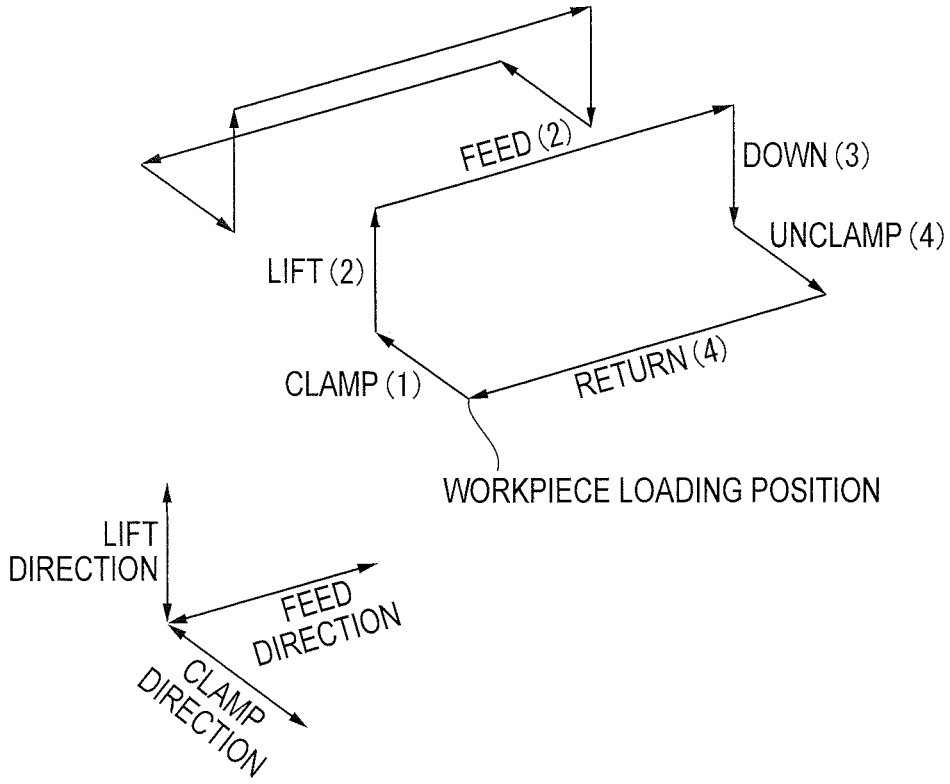
FIG. 5 is an illustration showing a motion of a transfer bar according to the first exemplary embodiment.

FIG. 5 shows a motion of the workpiece holder 33 according to this exemplary embodiment. As shown, a fundamental motion pattern of the bar 3 includes clamping, lifting up, feeding, lifting down, unclamping and returning.

(1) Firstly, the workpiece W is loaded and mounted on a workpiece receiving table (not shown) beside the bar 3 on the upstream side by a transfer device such as a general-purpose robot. At this time, as shown by a dashed-two dotted line in FIG. 3, the bar 3 is located at a down position (the lowest position where the bar 3 is lifted down: a lift-down stroke end) and at an unclamp position (where the bar 3 is separated from the other one: a clamp stroke separation end). When the first and second servo motors 56 and 57 are driven to move the first and second carriers 52 and 53 at the same speed in a direction where the bars 3 approach each other, the bars 3 move to a clamp position (where the bars approach each other: a clamp stroke approach end) without changing a height position. The workpiece W on the workpiece receiving table is held by the workpiece holder 33 attached to the bar 3.

(2) Next, while the workpiece W is held by the workpiece holder 33, the first servo motor 56 is driven to move the first carrier 52 toward the second carrier 53. As shown in FIG. 3 (by a solid line) and FIG. 5, the bars 3 are moved up in the lift direction L from the down position to a lift position (a lift-up stroke end). When the bars 3 are driven by the feeding linear motor 4, the bars 3 are moved in the feed direction F as shown in FIG. 7. Consequently, the workpiece W held by the workpiece holder 33 is transferred from the outside of the transfer press 1 for a first process step.

(3) When the workpiece W reaches a position for the first process step of a press-molding process, the first servo motor 56 is driven to move the first carrier 52 in a direction separating from the second carrier 53. Thus, the bars 3 are moved to the down position. The workpiece W is put on the lower die 122 for the first process step of the press-molding process.

(4) After the workpiece W is put on the lower die 122, the first and second servo motors 56 and 57 are driven to move the first and second carriers 52 and 53 at the same speed in the direction where the bars 3 are separated from each other. Then, as shown in FIG. 3, the bars 3 are moved from the clamp position to the unclamp position (unclamp motion), and the workpiece holder 33 is moved away from the workpiece W. Subsequently, when the bars 3 are driven by the feeding linear motor 4, the bars 3 return from the position in the first process step to the workpiece receiving table on the upstream. In short, the bar 3 moves back toward the original workpiece receiving table.

After the workpiece holder 33 moves to the unclamp position and reaches out of interference with the die 12, the slide 114 is moved down and the upper die 121 attached to the bottom surface of the slide 114 is moved down. The workpiece W is sandwiched between the upper die 121 and the lower die 122 under pressure to perform the predetermined first process step of the molding process.

Subsequently, the workpiece W is transferred for the next process step. The workpiece W is transferred and processed in the same manner as in the aforementioned molding process of the workpiece W in the first process step in which the workpiece W is transferred from the loading position to the position for the first process step of the press-molding process by the transfer feeder 2 and is processed. In other words, transferring of the workpiece by the transfer feeder 2 from the position for the first process step to a position for a second process step in the press-molding process and the molding process of the workpiece W in the second process step are performed in the same manner as the above. Moreover, transferring of the workpiece by the transfer feeder 2 from the position for the second process step to a position for a third process step in the press-molding process and the molding process of the workpiece W in a third process are performed in the same manner as the above.

After a most downstream process step of the workpiece W at a most downstream process position (a fifth process step in this exemplary embodiment) is finished, the workpiece W is transferred by the transfer feeder 2 from the most downstream process position in the press-molding process to the workpiece receiving table at a workpiece unloading position (a bar back end position) beside the bar 3. The molded workpiece W, which is unloaded to the workpiece receiving table located at the workpiece unloading position, is taken out of the press machine by a general-purpose robot and the like.

Thus, in the transfer feeder 2 according to this exemplary embodiment, the lift/clamp driving mechanism 5 moves the first and second carriers 52 and 53 separately or simultaneously in the clamp direction C, thereby performing both the motion of lifting the bar 3 up and down in the lift-up direction and the lift-down direction and the motion of reciprocating the bar 3 in the clamp direction and the unclamp direction which are horizontally perpendicular to the workpiece transfer direction T. The feeding linear motor 4 provided to the lift/clamp driving mechanism 5 reciprocates the bar 3 in the workpiece transfer direction T, namely, in the feed direction and the return direction. By properly reciprocating the bar 3 in the feed direction F, the lift direction L and the clamp direction C, the workpiece W is sequentially transferred from the lower die 122 on the upstream (the left side in FIG. 1) to the lower die 122 on the downstream (the right side in FIG. 1).

The transfer feeder 2 with the above arrangement can provide the following advantages.

Specifically, in the lift/clamp driving mechanism, since the first carrier 52 is guided by the outer guide 72 and the second carrier 53 is guided by the inner guide 73, the second carrier 53 can be positioned further inside the first carrier 52, the total dimension in the clamp direction C of the first and second carriers 52 and 53 can be shortened and the moving distance of the first and second carriers 52 and 53 can be increased to enlarge the moving range of the transfer bar 3 in the clamp direction C.

Moreover, since the lift/clamp driving mechanism 5 has a combined arrangement of the lift driving device and the clamp driving device which are typically individually provided, the bar 3 can be moved in the lift direction and the clamp direction only by changing a pattern of driving the first and second carriers 52 and 53. Accordingly, unlike the related arts, it is not required to vertically position the lift driving device and the clamp driving device, so that a height of the transfer feeder 2 can be reduced to provide a small-sized transfer feeder 2. Consequently, not only the transfer feeder 2 can be located more freely in the press main body 11 but also it becomes easy to replace parts for so-called retrofit which is popular these days.

Moreover, since requisite parts for lift-driving and clamp-driving the bar 3 are common, kinds of the component of the transfer feeder 2 can be decreased and a structure of the transfer feeder 2 can be simplified.

The lift/clamp driving mechanism 5 is provided on each side of the workpiece transfer direction T in a manner to correspond to each of the fixed bars 31 on the both ends of the bar 3. In other words, unlike the related arts in which a single first servo motor 56 and a single second servo motor 57 are provided to a single bar 3 for the lift-driving and the clamp-driving, two first servo motors 56 and two second servo motors 57 are provided therefor. With this arrangement, while keeping a total motor volume at each of the lift-driving and the clamp-driving at the same level, volume per motor can be reduced.

Herein, generally, increase in the motor volume lowers a motor efficiency represented by a peak torque ratio of the motor to inertia moment of the motor. However, in the transfer feeder 2 according to this exemplary embodiment, the volume of the first and second servo motors 56 and 57 of the lift/clamp driving mechanism 5 can be reduced, so that the motor efficiency can be improved. Accordingly, since driving force of the servo motors 56 and 57 can be efficiently utilized, the bar 3 can be lift-driven and clamp-driven at a higher speed.

In the lift/clamp driving mechanism 5, the support 51, first and second ball screws 54 and 55, parallel link 58, driving link 59, and balancer cylinder 60 are directly or indirectly connected to the first and second carriers 52 and 53 to be placed at the upper side of the frame 7. The first and second servo motors 56 and 57 are placed at a lower side of the frame 7. In short, among the components of the lift/clamp driving mechanism 5, the first and second servo motors 56 and 57 are placed at the lower side of the frame 7 and other components are placed at the upper side of the frame 7. With this arrangement, it is not necessary to house the lift/clamp driving mechanism 5 in the frame 7, thereby reducing a size and a weight of the frame 7.

Moreover, in the lift/clamp driving mechanism 5, the link 581, which is the first link of the parallel link 58, is connected to the support 51 and the first carrier 52 at a position higher than a position where the link 582, which is the second link of the parallel link 58, is connected thereto. With this arrangement, a distance in the clamp direction C between ends of the parallel link 58 can be reduced, and a distance in the clamp direction C between the support 51 and the first carrier 52 to which the parallel link 58 are connected can be reduced. Accordingly, the size of the transfer feeder 2 can be reduced, whereby the transfer feeder 2 can be located more freely in the press main body 11.

Since the feeding linear motor 4, which includes no rotary part and requires a small number of parts, is used as the feed driving mechanism for the bar 3, the weight, size and manufacturing costs of the feed driving mechanism can be reduced. Since the weight and size of the feeding linear motor 4 is reduced, vibration of the bar 3 at activation, abort and inching motion can be suppressed and the entire transfer feeder 2 can be operated at a high speed with a high positional accuracy, which enables a high-speed operation of the transfer press 1. Further, since the vibration of the bar 3 is suppressed, noise at driving can be reduced to improve working environments and durability of each part of the transfer feeder 2. As a result, maintenance performance of the transfer press 1 can be improved and a lifetime thereof can be prolonged.

Second Exemplary Embodiment

Figure 8:
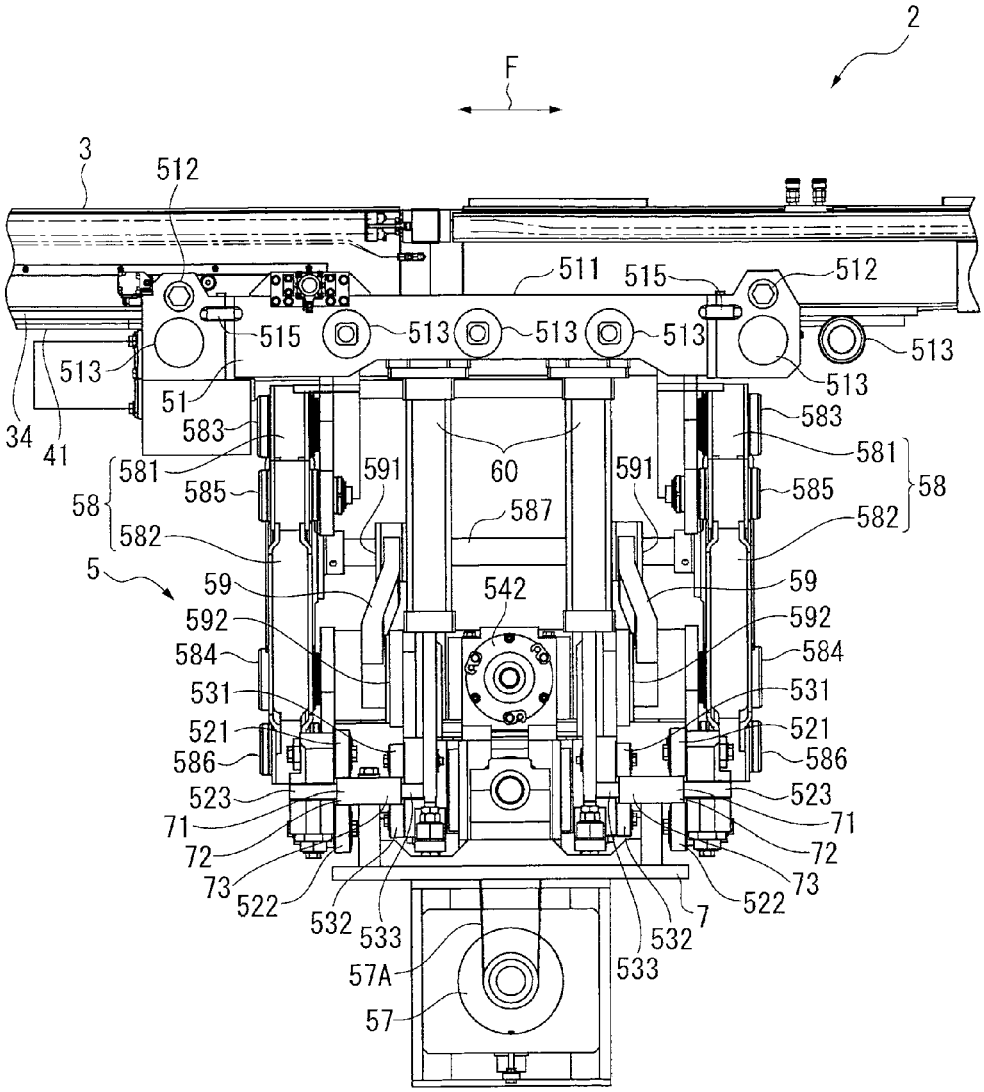
FIG. 8 is a front elevational view showing a lift/clamp driving mechanism according to a second exemplary embodiment of the invention.
Figure 9:
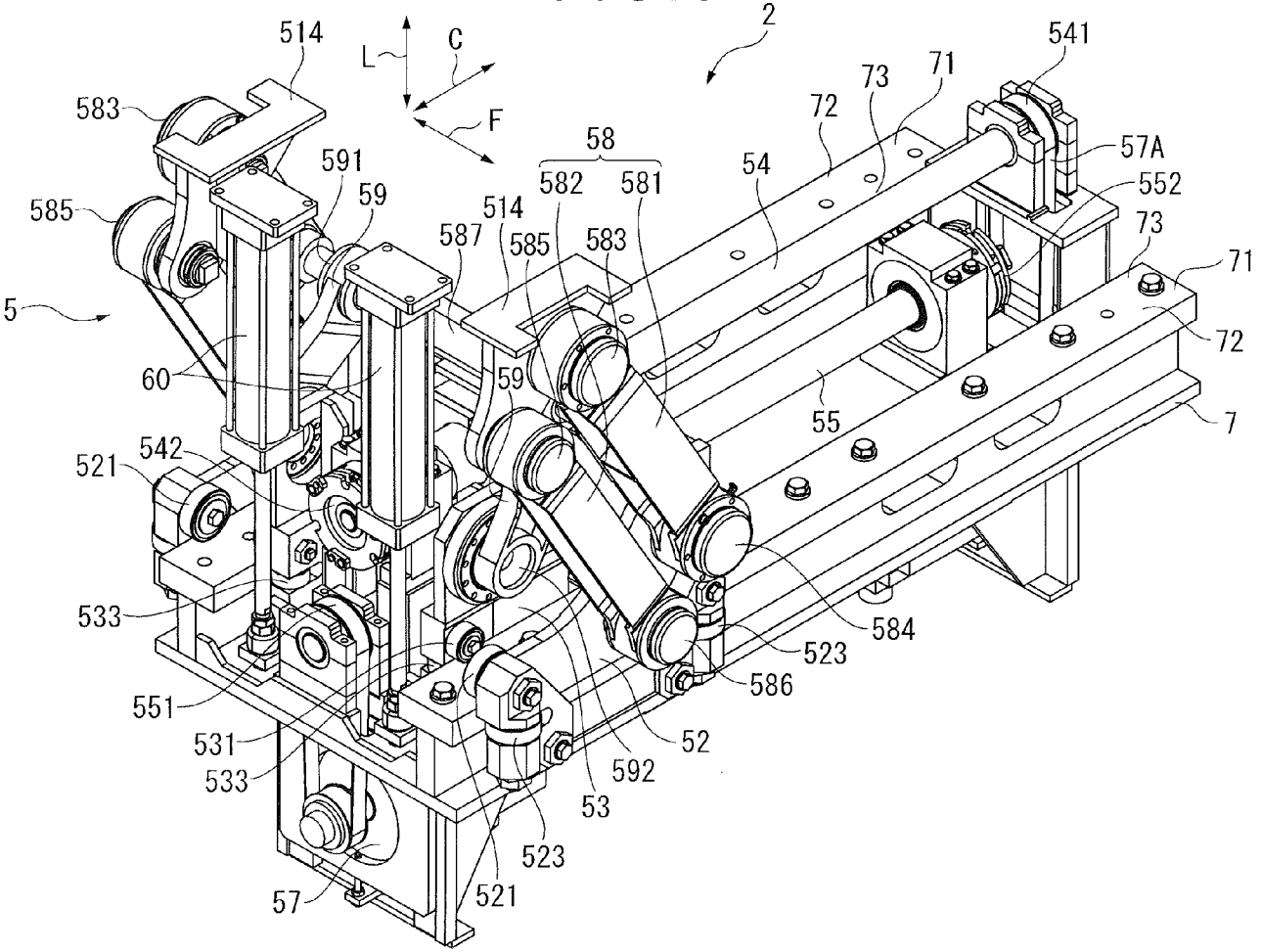
FIG. 9 is a perspective view showing the lift/clamp driving mechanism according to the second exemplary embodiment.
Figure 10:
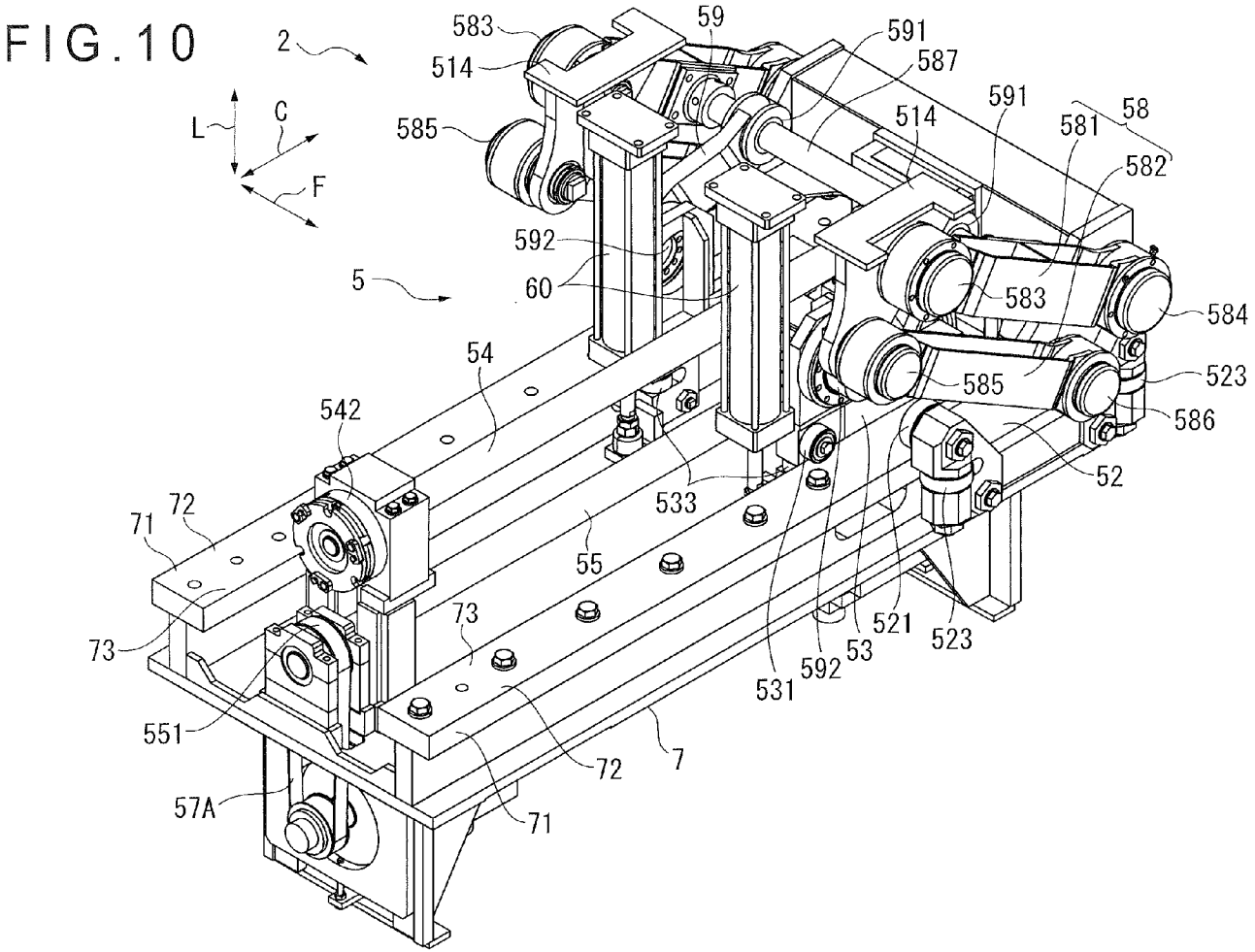
FIG. 10 is a perspective view showing another state of the lift/clamp driving mechanism according to the second exemplary embodiment.

A second exemplary embodiment of the invention will be described below with reference to FIGS. 8 to 10.

In the first and second carriers 52 and 53 according to the first exemplary embodiment, the upper guide rollers 521 and 531 and the lower guide roller 522 and 532 are provided in a manner to vertically sandwich the first and second guides 72 and 73 of the guide rail 71. However, in this exemplary embodiment, lateral guide rollers 523 and 533 on lateral sides of the guide rail 71 are additionally provided, whereby the movement of the first and second carriers 52 and 53 in the clamp direction C can be more reliably guided. Such lateral guide rollers 523 and 533 may be provided in the first exemplary embodiment.

In the first exemplary embodiment, each of the links 581 and 582 of the parallel link 58 is structured to have a longitudinal rib in the middle of a flat plate. However, each of the links 581 and 582 in this exemplary embodiment is provided by connecting a pair of flat plates to each other with a plate-like rib or a cross-shaped rib. Thus, with increased thickness, rigidity of the links 581 and 582 is enhanced. The driving links 59 is structured to have a plate and a rib surrounding the plate, whereby rigidity of the driving link 59 is enhanced. Such links 59, 581 and 582 are cast links.

In the pair of parallel links 58, the opposing links 581 are connected to each other via a metal connecting bar 587. The upper end of the driving link 59 is connected to the connecting bar 587. A spherical bush (not shown) is housed in a connector 591 between the driving link 59 and the connecting bar 587. The driving link 59 and the connecting bar 587 are connected via the spherical bush. The connection between the links 581 via the connecting bar 587 enhances rigidity between the parallel links 58.

According to the transfer feeder 2 with the above arrangement, rigidity of the components is enhanced and a secure guide structure is provided. Accordingly, larger force in the feed direction F can be reliably received from the feeding linear motor 4, so that the transfer bar 3 can be moved by the feeding linear motor 4 at a higher speed.

Third Exemplary Embodiment

Next, a third exemplary embodiment of the invention will be described below with reference to FIG. 11.

In the first exemplary embodiment, the feeding linear motor 4, which is provided as the feed driving mechanism for the bar 3, reciprocates the bar 3 in the feed direction F.

Figure 11:
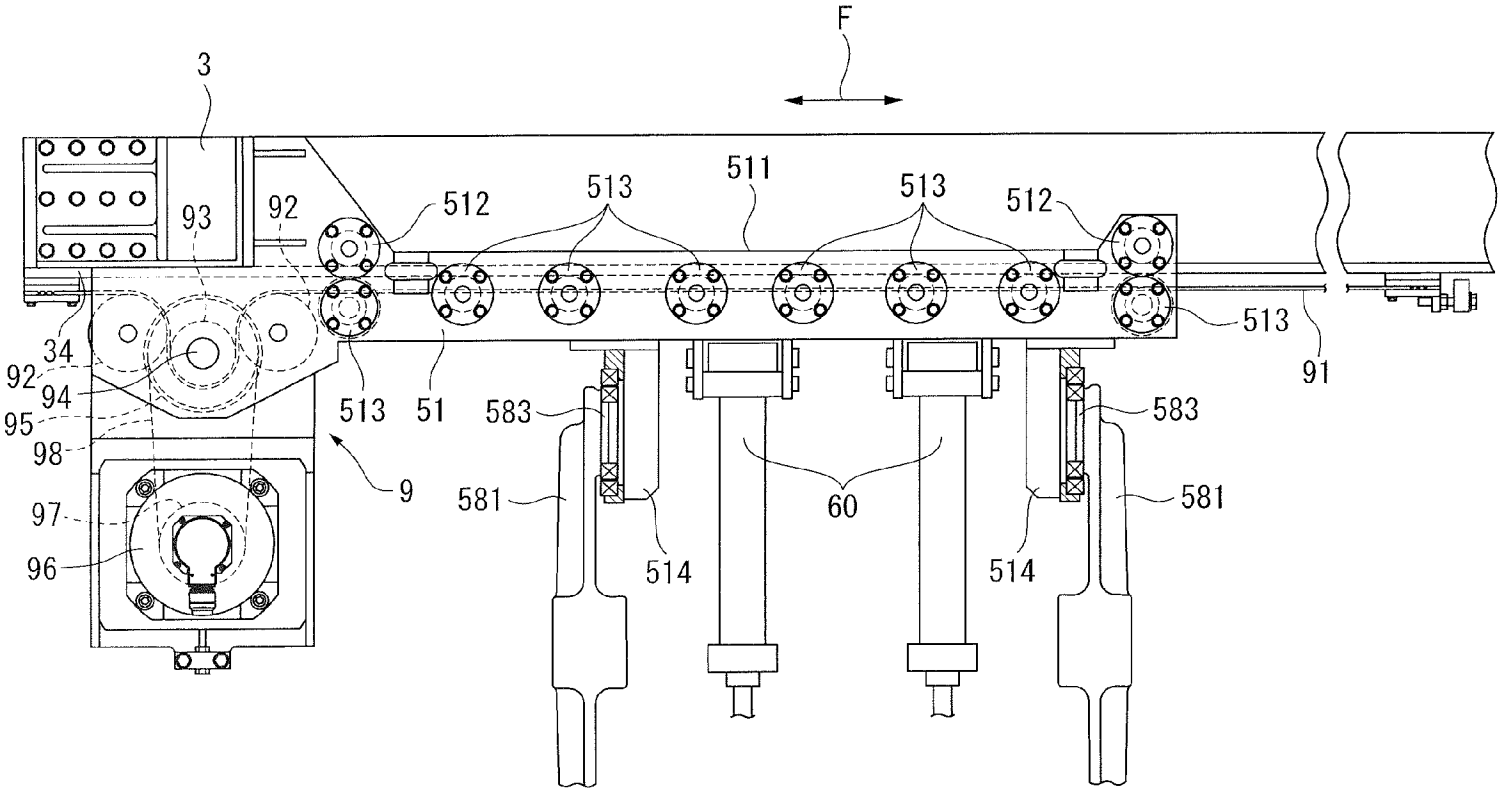
FIG. 11 is an illustration showing a feed driving mechanism of a workpiece transfer apparatus according to a third exemplary embodiment of the invention.

In contrast, in the third exemplary embodiment, as shown in FIG. 11, a timing belt mechanism 9 is used as the feed driving mechanism to reciprocate the bar 3 in the feed direction F, which is different from the first exemplary embodiment.

Specifically, the timing belt mechanism 9 is provided between the bar 3 and the support 51 and the entire timing belt mechanism 9 is supported by the support 51. The timing belt mechanism 9 includes: a timing belt 91 with ends fixed to the bar 3, the timing belt 91 being provided between the bar 3 and the support 51; guide pulleys 92 and 93 that guide the timing belt 91; a following pulley 95 that shares the guide pulley 93 with a rotation shaft 94; a servo motor 96; a motor shaft pulley 97 that is provided to an output shaft of the servo motor 96; and an endless belt 98 that is wound around the following pulley 95 and the motor shaft pulley 97.

In the timing belt mechanism 9 with this arrangement, rotative driving force of the output shaft of the servo motor 96 is transmitted to the following pulley 95 via the motor shaft pulley 97 and the endless belt 98 to rotate the following pulley 95, the rotation shaft 94 and the guide pulley 93. The timing belt 91 is transferred around a circumference of the guide pulleys 92 and 93 by the rotation of the guide pulley 93, whereby the bar 3 is reciprocated in the feed direction F in accordance with a rotation direction of the output shaft of the servo motor 96.

According to the transfer feeder 2 with the above arrangement, since the timing belt mechanism 9 is used as the feed driving mechanism, the weight of the feed driving mechanism can be reduced as compared with the arrangement in which the feeding linear motor 4 is used as the feed driving mechanism. Accordingly, a weight of the transfer feeder 2 can be reduced.

Moreover, the timing belt mechanism 9 is suitable for a high-speed driving of the bar 3. For instance, the bar 3 can be driven at a higher speed by the timing belt mechanism 9 as compared with when the bar 3 is driven with a ball screw. Accordingly, a high-speed transfer feeder 2 can be provided, which enables a high-speed operation of the transfer press 1.

Fourth Exemplary Embodiment

Next, a fourth exemplary embodiment of the invention will be described below with reference to FIG. 12.

In the first and second exemplary embodiments, the feed driving mechanism 4 and the lift/clamp driving mechanism 5 are provided under the bar 3.

Figure 12:
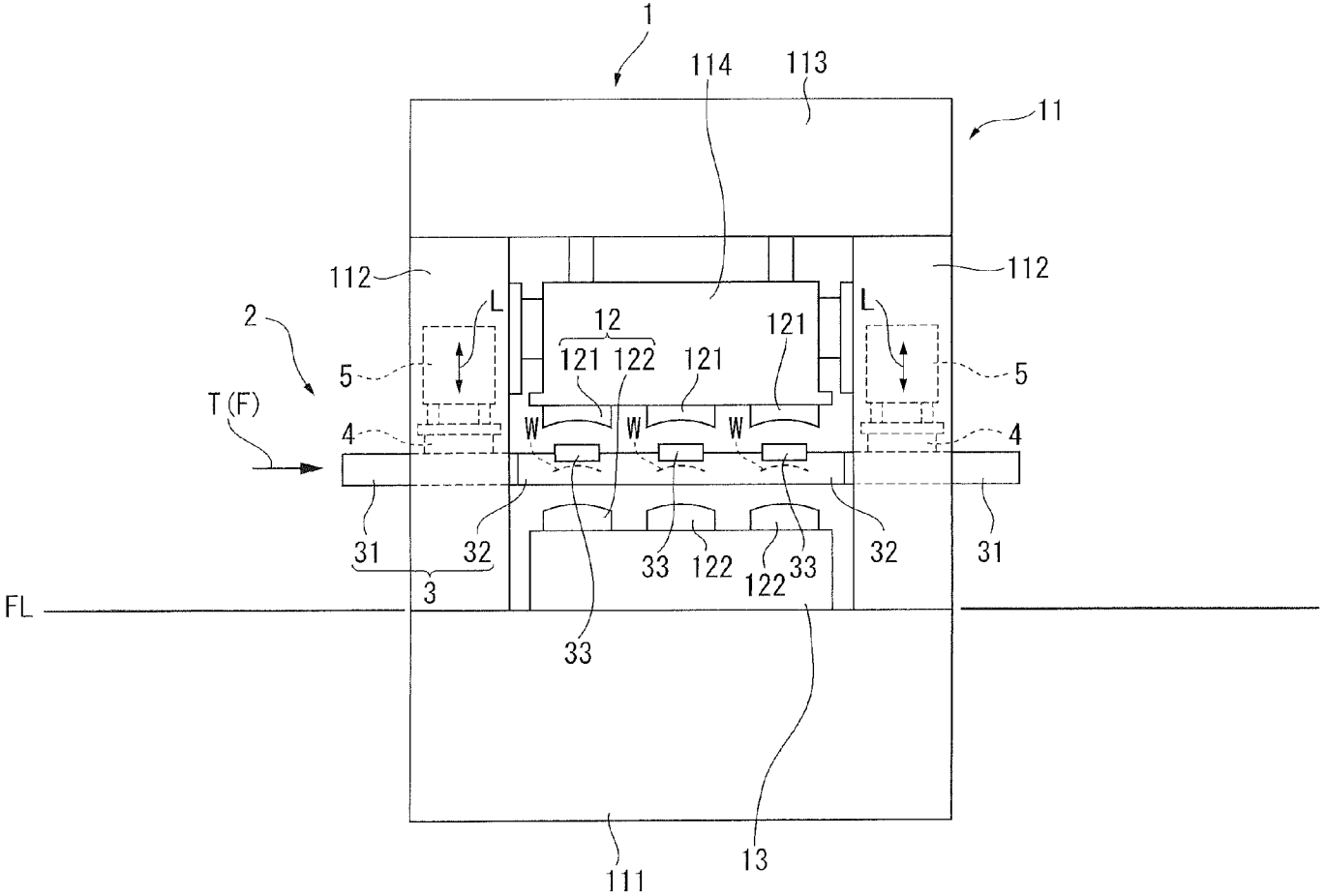
FIG. 12 is a front elevational view showing a press machine according to a fourth embodiment of the invention.

In contrast, in the fourth exemplary embodiment, as shown in FIG. 12, the feed driving mechanism 4 and the lift/clamp driving mechanism 5 are provided at an upper side of the bar 3, which is different from the first and second exemplary embodiments.

Specifically, in the transfer feeder 2 according to this exemplary embodiment, the lift/clamp driving mechanism 5 is suspended from the crown 113 to support the bar 3 in a manner movable in three-dimensions. The feed driving mechanism 4 is provided between the bar 3 and the lift/clamp driving mechanism 5.

In the lift/clamp driving mechanism 5, the first and second servo motors 56 and 57 are provided at the upper side of the frame 7 that is supported by the crown 113 through the frame legs 8, and the first and second carriers 52 and 53 are provided at the lower side of the frame 7 (an illustration is omitted in FIG. 12). The support 51, first and second ball screws 54 and 55, parallel link 58, driving link 59, and balancer cylinder 60 are directly or indirectly connected to the first and second carriers 52 and 53 to be placed under the frame 7.

According to the transfer feeder 2 with this arrangement, the lift/clamp driving mechanism 5 is located at the upper side of the bar 3. Accordingly, the view at the lower side of the bar 3 is not obstructed, so that visibility in the transfer press 1 can be improved.

Note that the present invention is not limited to the aforesaid embodiment but also includes modifications, improvements and the like as long as an object of the invention can be achieved.

For instance, in the above exemplary embodiments, the first and second carriers 52 and 53, which respectively bridge the first and second guides 72 and 73, are connected to the pair of parallel links 58 and the pair of driving links 59. However, the lift/clamp driving mechanism of the invention includes an arrangement with a single parallel link and a single driving link.

In the above exemplary embodiments, the pair of guide rails 71 are provided, in which the outer edges thereof are defined as the first guide 72 and the inner edges thereof are defined as the second guide 73. However, a single guide rail may be used, in which a first edge thereof in the clamp direction C may be defined as a first guide and a second edge thereof may be defined as a second guide. In this arrangement, a first link of the parallel link is connected to a first end of a short connecting bar, and the driving link is connected to a second end of the connecting bar.

The first guide for the first carrier and the guide for the second carrier may be individually provided on separate guide rails. In such an arrangement, the first and second carriers are provided close to each other in the feed direction and, for instance, the first and second ball screws are provided outside across the first and second carriers. With this arrangement, the parallel link and the driving link can be brought close to each other to be connectable in the same manner as in the first exemplary embodiment.

In the above exemplary embodiments, the feed driving mechanism 4 and the lift/clamp driving mechanism 5 are provided at a predetermined position relative to the bar 3 on the upstream side and the downstream side in the workpiece transfer direction T. However, the feed driving mechanism 4 and the lift/clamp driving mechanism 5 may be provided at different positions on the upstream side and the downstream side. Specifically, the feed driving mechanism 4 and the lift/clamp driving mechanism 5 may be provided at the lower side of the bar 3 on the upstream side of the workpiece transfer direction T. The feed driving mechanism 4 and the lift/clamp driving mechanism 5 may be provided at the upper side of the bar 3 on the downstream side. Moreover, layout of the feed driving mechanism 4 and the lift/clamp driving mechanism 5 may be reversed. Thus, the transfer feeder 2 can be located more freely in the press main body 11. Since the kinds of the parts of transfer feeder 2 of the invention are reduced, increase in costs can be prevented even with this arrangement.

In the above exemplary embodiments, the first and second carriers 52 and 53 are driven by the first and second ball screws 54 and 55 and the first and second servo motors 56 and 57. However, any component capable of driving the first and second carriers 52 and 53 may be applicable. For instance, a linear motor may be used for driving the first and second carriers 52 and 53 in the same manner as a linear motor is used for driving the bar 3. Specifically, a magnet plate is provided to one of the first and second carriers 52 and 53 and the frame 7 and a coil plate is provided on the other, whereby the first and second carriers 52 and 53 can be driven by the linear motor.

In the above exemplary embodiments, the bar 3 is driven by the feeding linear motor 4 or the timing belt mechanism 9. However, the feed driving mechanism of the invention includes any mechanism that is provided between the bar 3 and the support 51 and drives the bar 3.

In the above exemplary embodiments, the first and second ball screws 54 and 55 are offset in the vertical direction. However, the first and second ball screws 54 and 55 may be offset, for instance, in the feed direction F as long as the first and second ball screws 54 and 55 do not interfere with driving of the first and second carriers 52 and 53.

Rotative force of the first and second servo motors 56 and 57 are transmitted to the first and second ball screws 54 and 55 via the belts 56A and 57A. However, any component capable of transmitting rotative force may be applicable. For instance, other transmitters such as a gear and a chain may be used to transmit rotative force.

The invention claimed is:

1. A workpiece transfer apparatus of a press machine, comprising:

a pair of transfer bars that are provided parallel to a workpiece transfer direction;

a feed driving mechanism that drives the pair of the transfer bars in the workpiece transfer direction; and a lift/clamp driving mechanism that drives the pair of transfer bars in a lift direction to move up and down and drives the pair of transfer bars in a clamp direction perpendicular to the workpiece transfer direction, wherein the lift/clamp driving mechanism comprises:

a support that supports each of the transfer bars;

a first carrier that is movable in the clamp direction;

a second carrier that is movable in the clamp direction in a manner independent of the first carrier;

a first carrier driving mechanism that drives the first carrier in the clamp direction;

a second carrier driving mechanism that drives the second carrier in the clamp direction;

a parallel link including a first link and a second link that are connected to the first carrier and the support and are rotatable around a connector between the parallel link and the first carrier and a connector between the parallel link and the support;

a driving link that is connected to the first link of the parallel link and the second carrier and is rotatable around a connector between the driving link and the first link and a connector between the driving link and the second carrier;

a first guide that guides the first carrier to move in the clamp direction; and a second guide that guides the second carrier to move in the clamp direction, the first and second guides being parallel to each other and being shifted therefrom in the workpiece transfer direction.

2. The workpiece transfer apparatus of the press machine according to claim 1, wherein the connectors between the first and second links of the parallel link and the support are vertically located at different positions and the connectors between the first and second links of the parallel link and the first carrier are vertically located at different positions.

3. The workpiece transfer apparatus of the press machine according to claim 2, wherein the connector between the first link of the parallel link that is connected to the driving link and the support and the connector between the first link and the first carrier are located at higher positions than positions of the connectors of the second link.

4. The workpiece transfer apparatus of the press machine according to claim 1, wherein the first guide includes a pair of first guides that are parallel to each other, the first carrier is guided by the pair of first guides, the second guide includes a pair of second guides that are parallel to each other, the second carrier is guided by the pair of second guides, and the pair of second guides are located inside the pair of the first guides.

5. The workpiece transfer apparatus of the press machine according to claim 4, wherein the parallel link includes a pair of parallel links, and the pair of parallel links are connected to each other by a connecting bar.

6. The workpiece transfer apparatus of the press machine according to claim 5, wherein the driving link is connected to the parallel link via the connecting bar.

7. The workpiece transfer apparatus of the press machine according to claim 6, wherein the driving link is connected to the connecting bar via a spherical bush.

8. The workpiece transfer apparatus of the press machine according to claim 1, wherein the first carrier driving mechanism comprises a first ball screw that is screwed to the first carrier, the second carrier driving mechanism comprises a second ball screw that is screwed to the second carrier, and the first and second ball screws are vertically located.

9. The workpiece transfer apparatus of the press machine according to claim 1, wherein the feed driving mechanism is interposed between the transfer bar and the support.

10. The workpiece transfer apparatus of the press machine according to claim 1, further comprising:

a balancer cylinder that connects the second carrier to the support.

11. The workpiece transfer apparatus of the press machine according to claim 1, further comprising:

a frame located on each side of the workpiece transfer direction of a moving bolster, wherein the first carrier driving mechanism comprises a first ball screw that extends in the clamp direction and a first servo motor that rotates the first ball screw, the second carrier driving mechanism comprises a second ball screw that extends in the clamp direction and a second servo motor that rotates the second ball screw, the first and second carriers, the support, the parallel link and the driving link are provided at an upper side of the frame, the first ball screw is screwed to the first carrier and is provided at the upper side of the frame, the second ball screw is screwed to the second carrier and is provided at the upper side of the frame, and the first and second servo motors are provided at a lower side of the frame.

12. The workpiece transfer apparatus of the press machine according to claim 1, further comprising:

a frame located on each side of the workpiece transfer direction of a moving bolster, wherein the first carrier driving mechanism comprises a first ball screw that extends in the clamp direction and a first servo motor that rotates the first ball screw, the second carrier driving mechanism comprises a second ball screw that extends in the clamp direction and a second servo motor that rotates the second ball screw, the first and second carriers, the support, the parallel link and the driving link are provided at a lower side of the frame, the first ball screw is screwed to the first carrier and is provided at the lower side of the frame, the second ball screw is screwed to the second carrier and is provided at the lower side of the frame, and the first and second servo motors are provided at an upper side of the frame.

13. The workpiece transfer apparatus of the press machine according to claim 1, wherein the feed driving mechanism and the lift/clamp driving mechanism are provided between uprights on an upstream side and between uprights on a downstream side of the workpiece transfer direction.

14. A workpiece transfer unit including:

a lift/clamp driving mechanism arranged into a unit, the lift/clamp driving mechanism being included in a workpiece transfer apparatus of a press machine, the workpiece transfer apparatus comprising:

a pair of transfer bars that are provided parallel to a workpiece transfer direction;

a feed driving mechanism that drives the pair of the transfer bars in the workpiece transfer direction; and the lift/clamp driving mechanism that drives the pair of transfer bars in a lift direction to move up and down and drives the pair of transfer bars in a clamp direction perpendicular to the workpiece transfer direction, wherein the lift/clamp driving mechanism comprises:

a support that supports each of the transfer bars;

a first carrier that is movable in the clamp direction;

a second carrier that is movable in the clamp direction in a manner independent of the first carrier;

a first carrier driving mechanism that drives the first carrier in the clamp direction;

a second carrier driving mechanism that drives the second carrier in the clamp direction;

a parallel link including a first link and a second link that are connected to the first carrier and the support and are rotatable around a connector between the parallel link and the first carrier and a connector between the parallel link and the support;

a driving link that is connected to the first link of the parallel link and the second carrier and is rotatable around a connector between the driving link and the first link and a connector between the driving link and the second carrier;

a first guide that guides the first carrier to move in the clamp direction; and a second guide that guides the second carrier to move in the clamp direction, the first and second guides being parallel to each other and being shifted therefrom in the workpiece transfer direction.

* * * * *